United States Patent [19]

Lockwood

[11] 4,334,366

[45] Jun. 15, 1982

[54] SONIC ENERGY PERFORATED DRUM FOR ROTARY DRYERS

[75] Inventor: Raymond M. Lockwood, Palo Alto, Calif.

[73] Assignee: Jetsonic Processes, Ltd., Sacramento, Calif.

[21] Appl. No.: 190,296

[22] Filed: Sep. 24, 1980

[51] Int. Cl.[3] ..... F26B 5/02

[52] U.S. Cl. ..... 34/17; 34/133; 34/164; 34/191; 432/105; 432/108; 426/465

[58] Field of Search ..... 34/34, 191, 133, 164; 159/4 A, 4 E, 16 R, ; 432/105, 106, 108; 426/465, 520; 99/483

[56] References Cited

U.S. PATENT DOCUMENTS 3,175,299 3/1965 Boucher ..... 34/191

3,592,395 7/1971 Lockwood ..... 34/10

3,641,680 2/1972 Candor et al. .

3,831,294 8/1974 Freze ..... 34/77

*Primary Examiner*—Larry I. Schwartz

*Attorney, Agent, or Firm*—Christie, Parker & Hale

[57] ABSTRACT

A perforated drum serves as a drying chamber into which moist particles are loaded. The drum is rotated about a horizontal axis to tumble the particles. Sonic energy and hot pulsating gas from a pulse jet engine are supplied to a plenum opening into the drum.

The gas flows through the drum transversely to the axis and contacts the tumbling particles to dry them. A shroud encloses the drum. Moisture-laden gas exhausted from the drum is collected in the shroud and recycled to the pulse jet engine. Sonic energy escaping from the drum is reflected by the shroud back into the drum. The particles are continually exposed to pulsating hot gas and reflected sonic energy. Dried product is withdrawn from the dryer.

27 Claims, 4 Drawing Figures

38
2
49
31
37
30
15
15
16
53
15
13
52
11
14
10
42
44
3
32
18
50
21
2

41
38
37
37
49
12
16
31
10
12
34
13
19
17
18
42
44
32

SONIC ENERGY PERFORATED DRUM FOR ROTARY DRYERS

BACKGROUND OF THE INVENTION

This invention provides an improved method and apparatus for drying food and other commodities in a tumbling environment.

Rotary dryers are used today for drying of nuts and other commodities. In one commercial application, the nuts are introduced into a horizontal cylindrical drum, which is rotated about its horizontal axis to tumble the nuts. The drum is perforated, and hot gas from a conventional source, such as gas burners, is introduced from under the drum, flows through the perforations, and contacts the tumbling nuts for drying.

Inasmuch as drying depends on convection of hot gases past tumbling particles, the dryer suffers serious limitations. First, the rate of drying falls off after a portion of the moisture has been removed. The last few points of moisture removal take the longest and increase the cost of drying. If one attempts to increase the rate of moisture removal by increasing the temperature of the drying gas, the risk of overdrying or scorching the nuts becomes unacceptable.

The efficiency of drying is proportional to the temperature of the drying gas. However, product scorching or overdrying sets a practical upper limit for the gas temperature.

Most commercially dried food products have an empirically defined "safe" temperature, above which the risk of damaging the food particles with a conventional hot gas source becomes unacceptable. At or below this "safe" temperature, the product is protected from damage by a protective layer of moisture on its surface. The "safe" operating temperature is a wet bulb temperature and depends on this surface layer of moisture.

Heatless drying using ultrasonic energy has been used to dry slurries and other powdery materials. Sonic drying can be faster than drying performed by convection of hot gases and has the potential of increasing the capacity of drying systems. It is believed that the sonic energy removes the surface layer of moisture as soon as it can form on the particle. However, if sonic drying were to be combined with convection of hot gases, the particle would be exposed to the hot gas without the benefit of a protective surface film of moisture. Drying would occur at a dry bulb temperature. Such a proposed drying method would have to be carried out at a lower temperature than the empirically defined "safe" temperature in order to protect the product from damage. The efficiency of drying, which depends directly on the temperature of the hot gas, would suffer as a result.

One dryer using pulsating hot gas and sonic energy from a pulse jet engine is shown in U.S. Pat. No. 3,592,395, filed Sept. 16, 1968, to Lockwood et al. However, this dryer is a stirred fluid bed dryer which operates under different principles from rotary dryers and handles different products. The fluid bed dryer readily handles slurries or other fine powdery materials. However, the market pays a premium for recognizable pieces of food instead of powders. Any mechanically induced stirring will tend to break up the food pieces into smaller particles which are less valuable commercially. Moreover, mechanical stirring can damage delicate pieces.

The Lockwood fluid bed dryer has a set of rotatable stirring blades closely spaced above a horizontal floor. The blades rotate about an upright axis through the center of the floor. Hot pulsating gas and ground material in the form of a slurry enter the dryer at its center and flow under the blades toward an outer wall. Hot gas flows from under the blades to fluidize the bed. However, the gas is much hotter than the slurry and initially contacts a relatively small slurry volume. This tends to scorch or burn the product. Moreover, during start-up and shutdown, material sometimes tumbles down the centrally located hot gas inlet and causes fires. Furthermore, the fluidized bed tends to become nonuniform. The gas eventually geysers or erupts through some weak spot in the bed, and fluidization collapses.

High drying temperatures can promote product degradation by accelerating deleterious enzymatic and chemical processes. Efficiency must be sacrificed for product wholesomeness.

The unique structure of nuts presents an additional problem. The shell of the nut has a permeability different from the meat. An unsolved problem is to drive the moisture from both the meat and the shell economically and uniformly.

There is need for a rotary dryer which can remove moisture efficiently at low product drying temperatures, but at relatively higher gas dry-bulb temperatures.

There is also a need for a dryer which can safely combine hot gas convection and sonic energy at normal operating temperatures without damaging the product.

SUMMARY OF THE INVENTION

This invention provides improvements in the drying of food pieces. A rotary dryer having a perforated, cylindrical, horizontally rotating drum as a drying chamber is combined with a pulse jet engine which provides pulsating hot gas and sonic energy as products of combustion to the drum for rapid and efficient drying. The food pieces are gently tumbled in the drum while exposed to a cross-flow of gas which is transverse to the drum's axis of rotation. Preferably, the drum is enclosed in a shroud which collects moisture-laden stack gas from the drying chamber. The shroud has a curved inner surface to reflect sonic energy escaping from the drum. The surface curvature focuses the sonic energy so that it returns to the drum and passes again through the bed. The shroud functions to recycle sonic energy to the pieces and gas to the pulse jet engine. This gas recycles to the pulse jet engine which pumps the gas, along with sonic energy, back to the drying chamber. As in widely accepted conveyor-dryer practice, about one part in four or five parts of recycled gas is exhausted to atmosphere. This balances the amount of inlet air to support the combustion process. Continuous drying is performed in an oxygen-depleted or inert atmosphere, which greatly improves product flavor and quality.

In terms of apparatus, there is provided a cylindrical drum having a substantially horizontal axis and a perforated surface. Means are provided for introducing moist particles into the drum. Means are provided for rotating the drum about the axis to tumble the particles.

A gas plenum opens into the drum. The perforated rotating surface of the drum permits gas from the plenum to enter the drum, while retaining the tumbling particles inside the drum. A pulse jet engine is arranged to supply pulsating hot gas and sonic energy to the plenum. The pulsating hot gas and sonic energy enter the drum through the perforations. There is a cross-flow of gas in the drum which is transverse and preferably perpendicular to the axis of rotation. The pulsating hot gas and sonic energy contact the tumbling particles to cause them to dry. Means are provided for withdrawing dried particles from the drum.

In a preferred embodiment, a shroud encloses the drum for collecting gas escaping from the drum through the perforations. Gas recycles from the shroud preferably via a conduit to the pulse jet engine. A supercharging blower preferably is used with the pulse jet heater-blower.

In terms of method, moist particles are introduced into a drying space formed by a container. Pulsating hot gas and sonic energy are supplied into the container. Such pulsating hot gas and sonic energy contact a surface of the particles to cause them to dry. During the drying process, the container is agitated about a horizontal axis to expose a different surface of the particles to the pulsating hot gas and sonic energy. Dried particles are withdrawn from the drying space.

In another preferred practice of the method, moist particles are introduced into a drying chamber formed by a cylindrical drum having a perforated surface and a substantially horizontal axis. The drum is rotated about the axis to tumble the particles inside the drum. Pulsating hot gas and sonic energy are supplied to a plenum in contact with the drum and enter the drum and contact the particles to cause them to dry. It is preferred that the gas flows transversely to the axis. Dried particles are withdrawn from the dryer.

It is also preferred that gas entering the drying chamber be collected and recycled to a pulse jet engine which supplies the pulsating hot gas and sonic energy to the gas plenum. Preferably, moisture is removed from the recycled gas during the recycling step.

The drying may also be performed in stages by coupling together two or more such rotary dryers and operating each at a progressively lower temperature.

Other features and advantages of this invention will become apparent to those skilled in the art from the accompanying drawings and description.

BRIEF DESCRIPTION OF THE DRAWING

The following description is presented with reference to the accompanying drawings, where the same numeral appearing in different drawings refers to the same detail, and wherein.

DETAILED DESCRIPTION OF THE PREFERRED EMBODIMENT

Figure 1:
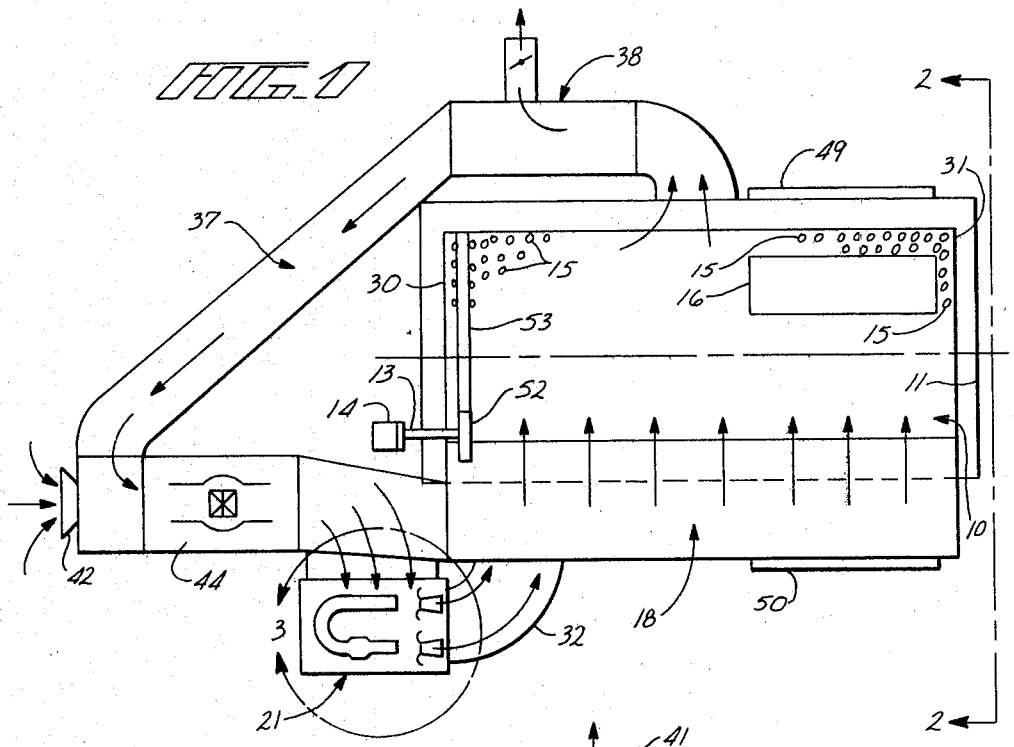
FIG. 1 is a sectional schematic elevation of a rotary screen dryer, according to this invention.
Figure 2:
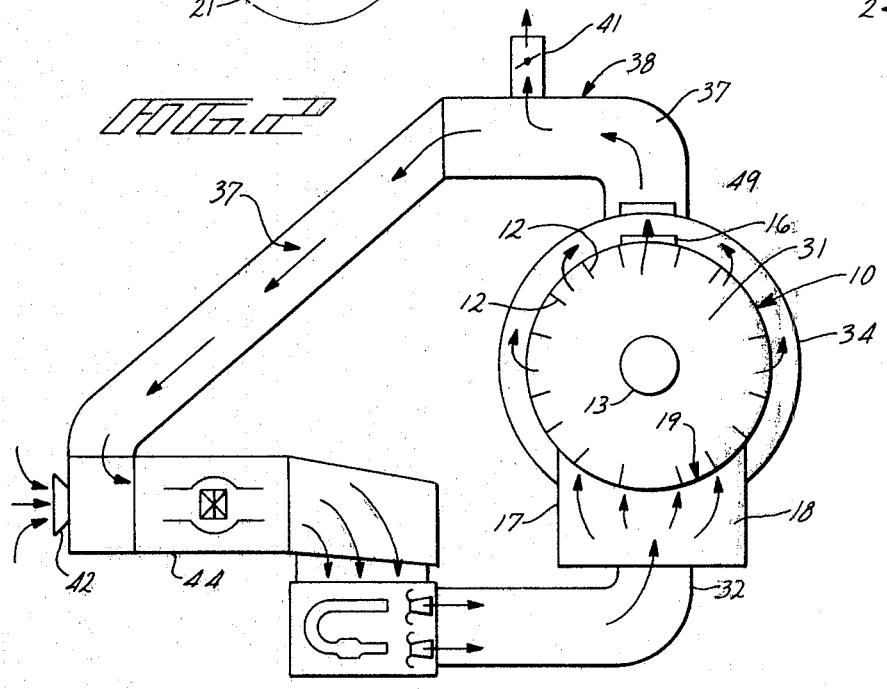
FIG. 2 is an end elevation taken along arrows 2—2 of FIG. 1.

A rotary dryer according to this invention is shown in FIGS. 1 and 2. A drum 10 has a substantially horizontal axis 11. A track 52 around the drum receives a gear 53 which is coupled to a suitable drive mechanism, such as a shaft 13 and an electric motor and gearing 14 for rotatably driving the drum about axis 11.

The drum is preferably enclosed in a shroud 34. Moist particles are introduced into the drum to initiate the drying process.

In FIG. 1, which is a presently preferred embodiment of a batch dryer, a load of particles is inserted through a hatch 16 on the drum surface. For loading, the drum is rotated slowly to line up hatch 16 with a loading hatch 49 on the upper part of the shroud. Hatches 49 and 16 are opened, and the particles are poured into the drum. For unloading, the drum is rotated slowly to line up hatch 16 with an unloading hatch 50 on the bottom of the shroud, and the hatches are opened to discharge the product.

The drum is rotated during operation to tumble the particles. The drum is driven slowly at from around one to around fifteen, and preferably from around three to around eight revolutions per minute. Rotation about axis 11 establishes a gentle tumbling of the particles, which changes the surface of the particles which is exposed to hot gas and sonic energy.

The rotating surface of the drum is perforated so that gas from a plenum 18 opening into the drum can communicate with the interior of the drum, while the tumbled particles are retained inside the drum. For this purpose, a plurality of perforations 15 are smaller than the particles intended for the dryer, which preferably are nuts or food slices, dices, or other discrete pieces which do not enter the dryer in a sloppy, slurry form. In the preferred embodiment, the rotating cylindrical surface of drum 10 includes perforations 15, which have a diameter of from about 1/16" to about $\frac{1}{8}$". The perforations occupy from about 30% to about 70%, and preferably from about 40% to about 60%, of the surface of the drum.

An upwardly opening duct structure 17 forms a gas plenum 18 under the drum. Preferably, the gas plenum opens into a lower portion 19 of the rotating drum surface. The plenum functions to provide a substantially uniform temperature and sound distribution in the direction of axis 11 beneath the drum. Preferably, the duct structure 17 is sufficiently long in the direction of axis 11 so that plenum 18 extends across both ends of the drum. In the presently preferred embodiment using a perforated drum, there is a cross-flow of gas transverse to rotational axis 11 of the drum. The plenum need not be centered directly under axis 11, but may be canted to one side in the direction of drum rotation to better expose particles in the drum to pulsating hot gas and sonic energy from the plenum.

Figure 4:
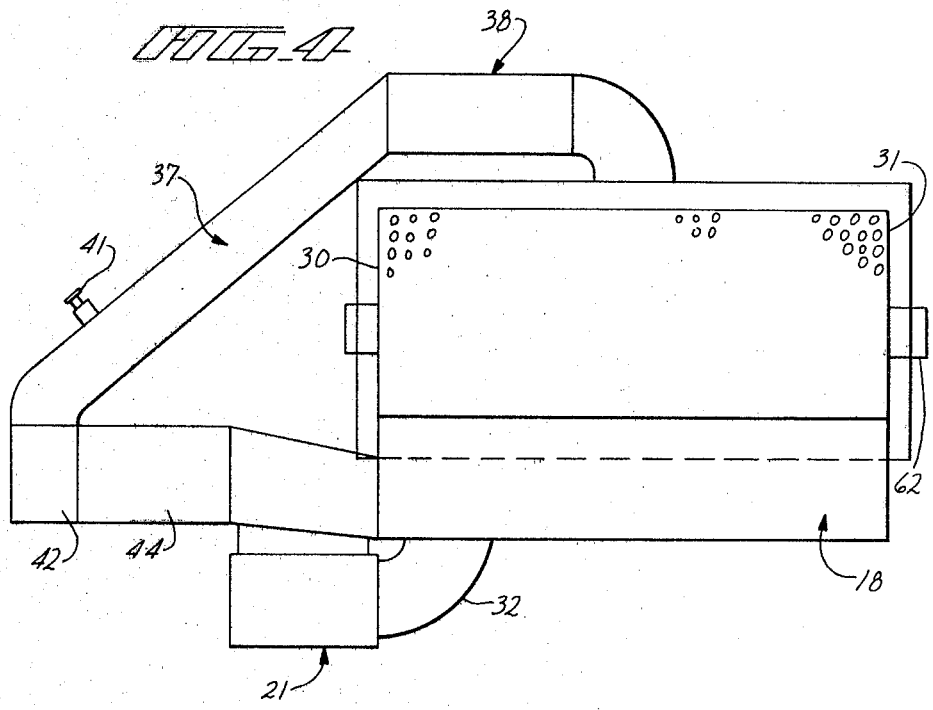
FIG. 4 is a section schematic elevation of a plurality of rotary screen dryers, according to this invention.

The drum preferably includes a plurality of flights 12, which help to lift and tumble the particles as the drum rotates. The flights preferably run the length of the drum. In a continuous feed drum, such as are illustrated in FIG. 4, preferably the flights are angled or spiral with respect to axis 11 in order to move particles from one end of the drum to the other.

Figure 3:
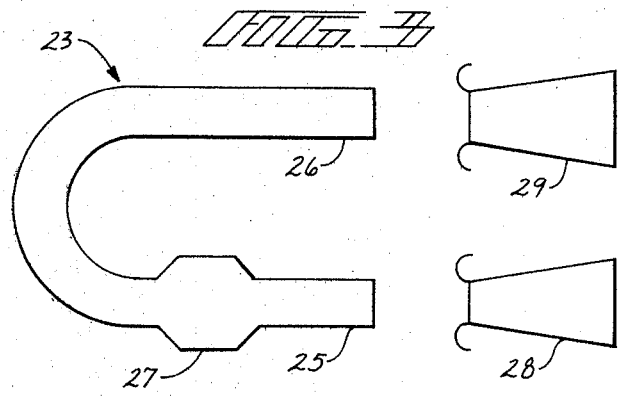
FIG. 3 is an enlarged section of a pulse jet engine used in the rotary dryer and taken along arrows 3—3 of FIG. 1.

A heater/blower package 21 includes a pulse jet engine 23 which transmits heat, air movement, and a wide spectrum of sonic energy waves to the gas plenum 18. The pulse jet heater and blower package 21, shown in FIG. 2, houses the pulse jet engine 23, which is shown in enlarged view in FIG. 3. A description of pulse jet engines of the type used herein, entitled "Pulse Reactor Low Cost Lift Propulsion Engines," dated May, 1964, by R. M. Lockwood, AIAA Paper No. 64-172, is available from the American Institute of Aeronautics and Astronautics, 1290 Sixth Ave., New York 10009.

The pulse jet engine includes a combustion chamber 27 and a pair of exhausts, which are referred to as the inlet 25 and the tailpipe 26. A passageway in the combustion chamber receives air/fuel mixtures. A spark plug ignites the initial mixture. When the explosive-type combustion occurs, increased pressure forces hot gas out from both ends of the combustor, that is, from the so-called inlet as well as from the tailpipe. Overexpansion causes a relative vacuum to form in the combustion chamber, which draws oxygen-containing gas to support combustion from the atmosphere surrounding the inlet 25, and hot gas from the tailpipe 26. The hot exhaust gas ignites a new air/fuel mixture while the oxygen-containing gas supports its combustion which produces another cycle of combustion and expansion. The process proceeds indefinitely without moving parts as long as fuel and sufficient oxygen-containing gas to support combustion are supplied to combustion chamber 27.

To increase thrust from the pulse jet engine, a pair of tubular augmentors or jet pumps 28 and 29 are placed, respectively, in the line of exhaust from inlet pipe 25 and tailpipe 26. Each augmentor significantly increases thrust by pulling gas from its vicinity into the respective exhaust stream.

The pulse jet engine preferably consumes propane, although pulse jet combustors are relatively insensitive to the particular fuel used and will operate on a wide variety of air-reacting fuels, preferably, for example, gasoline, fuel oils, butane, and producer gas.

The pulsating hot gas and sonic energy are conducted via a duct 32 to the hot gas plenum 18. The pulsating hot gas and sonic energy enter drum 10 through perforations 15 in the lower portion 19 of the drum, which is in contact with the upper part of the hot gas plenum 18. The pulsating hot gas flows through the drum transversely to the axis of rotation 11. The sonic energy waves reflect off the tumbling particles and the wall of the cylindrical drum and impinge upon nearby particles in the tumbling bed of drying material which would otherwise be less completely exposed to the hot gas and sonic energy. The pulsating hot gas and sonic energy contact the tumbling particles and cause them to dry uniformly throughout the tumbling bed of material.

The embodiment illustrated in FIGS. 1 and 2 utilizes cross-flow of gases transverse to the axis 11 of the drum. In one preferred embodiment of a continuous feed dryer, shown in FIG. 4, material is continuously fed into an inlet 60 at one end 30 of the drum. The gas flow is transverse to the feed of material. The material is directed by the flights to travel along the axis of the drum from the input end 30 to an output end 31 transverse to the gas flow.

The pulse jet engine provides three by-products of pulse combustion: heat, sonic energy, and oscillative pumping of gas. The combination of these three forms of energy along with gentle tumbling of the particles increases the rate of drying and the permissible "safe" temperature as compared to drying performed with conventional hot gas sources.

The broad-band sonic waves produced by the pulse jet engine are composed of compression waves closely coupled with rarefaction waves. It is believed that the sonic energy waves, which can be on the order of several cycles to several thousand cycles per second, produce a "push-pull" effect which effectively removes moisture as soon as it forms on the surface of a particle. It is also believed that the broad-band sonic energy waves resonate the particles at their natural frequencies to accelerate the removal of moisture from deep within the particle to its surface. At the surface, the rapid sonic oscillations suck the moisture away from the particle. However, it is believed that the sonic energy penetrates into the interior of a bed of particles less readily than does heat. The shroud 34 has a rounded inner surface, preferably cylindrical, to enclose the drum and to provide a reflective surface for sonic energy waves. When sonic energy passes through the bed of tumbling material, it reflects off the drum's inner wall and passes back through the bed. However, some sonic energy passes through the perforations 15 and enters the space inside shroud 34. The sonic waves reflect off the inner surface of the shroud. The curved inner shroud surface focuses the sonic energy so that it encounters the drum and reenters through some perforations 15 to pass through the bed.

The efficiency of drying is proportional to the temperature of the drying gas. However, product scorching or burning sets a practical upper limit for the gas temperature. Most commercially-dried food products have an empirically defined "safe" temperature above which the risk of damage or scorching the food particles with a conventional hot gas source becomes unacceptable. If the particles are not tumbled, the temperature must be further limited, because the first particles to contact the hot gases will tend to scorch or burn, whereas the rest of the particles may be at a "safe" temperature. The first particles will scorch or burn unless the temperature of the pulsating hot gas is relatively low, certainly below the "safe" temperature for drying using a conventional hot gas source.

The drum is preferably rotated about axis 11 to tumble the particles. However, the drum may also be agitated about axis 11 to agitate the particles to expose different surfaces of the particles to the pulsating hot gas and sonic energy during the drying process.

By agitating the particles in the drying chamber, preferably by tumbling, the surfaces of the particles exposed to the hot gas and sonic energy remain in contact briefly enough with the hot gas so that the risk of burning or scorching is essentially eliminated. Tumbling enables the temperature of the hot pulsating gas to be raised substantially, so that the temperature of the gas entering the plenum may safely be as high as 275° F., instead of being limited to 170° F. or lower so as to prevent scorching, unattractive color changes, flavor losses, destruction of delicate nutrients, etc. The gas temperature operating with sonic energy may then be at least as great as the corresponding "safe" temperature defined for drying with conventional hot gas sources and may be much higher than is safe with quiescent beds as in conveyor or belt dryer practice. The rate of drying with the combination of pulsating hot gas and sonic energy applied to either agitated or tumbling particles can be anywhere from one to around ten times as fast as drying using conventional hot gas methods.

The pulse jet engine also provides kinetic energy in the form of pumping of gas. This reduces the cost of moving the gas.

Preferably, the dryer includes a shroud 34 for operating in a closed system and for reflecting sonic energy back into the drum. Shroud 34 encloses the entire drum and forms a gastight seal with duct structure 17 forming the plenum. Due to the continuous pumping of gas into the plenum, the system is under a mild pressure, and any gas entering the drum 10 eventually will be forced out through the perforations and be contained in shroud 34, along with any gas escaping from the plenum. Since the gas entering the drum picks up moisture from the exposed particles, the perforations provide a useful vehicle for exhausting moisture from the drum. The moisture is carried out the perforations by the exhausted gas which is collected in the shroud.

In the embodiment of FIGS. 1 and 4, a conduit 38 is coupled to the top of the shroud 34 and to the heater/-blower package 21. The conduit defines a recycle stream 37 and directs gas exhausted from the drum to return to the pulse jet engine.

In the recycle stream, there are preferably a moisture removal device 41 or vent to atmosphere and an air inlet damper 42. The moisture removal device preferably comprises any valve which is capable of discharging an adjustable portion of the moisture-laden gas from the recycle stream. The air inlet damper 42 preferably admits sufficient oxygen-containing gas to recycycle stream 37 to support continuous combustion in a pulse jet engine. The damper comprises any valve 43 which is capable of admitting an adjustable volume of air into recycle stream 37.

A supercharging blower 44 pumps the recycle stream to maintain the gas flow through the entire system. Blower 44 also supercharges the oxygen content of the atmosphere at the inlet end of the pulse jet engine to provide sufficient oxygen to support continuous combustion. Preferably, the volume of air admitted at blower 44 is substantially equal to the volume of recycle gas discharged at the moisture removal device 41. If the volume of air admitted is significantly greater, the system will develop an undesirable back pressure, and the flow of gas, and the rate of moisture removal from the particles in the drum, will be reduced. If the volume of air admitted is significantly less, the system will develop an undesirably low pressure, and the moisture-laden gas will not readily exhaust from the drum.

In the presently preferred embodiment, the pulse jet engine consumes propane and provides approximately 1 million BTUs per hour. Pulsating hot gas and sonic energy are pumped to plenum 18 by blower 44 and by the pumping action of the pulse jet engine. From the plenum, the gas and sonic energy pass through the perforations 15, preferably transversely to axis 11, and enter the drum. The pulsating hot gas and sonic energy contact exposed surfaces of the tumbling particles and cause them to dry.

The individual particles contact the hottest gas when they are near the lower portion 19 of the drum. Due to the drum rotation and the lifting action of the flights, the particle moves away from lower portion 19 and gives up moisture to the pulsating hot gas. The particle eventually tumbles back to the lower portion of the drum and contacts another volume of fresh hot gas entering the drum. The particle surface exposed to and contacting the pulsating hot gas changes during the drying process. However, the particle is continually exposed to sonic energy due to the reflections generated at the drum and the shroud. Dried particles are removed from the dryer through trap door 47 and are collected for storage.

The pulsating hot gas picks up moisture in the drum. Due to the continuous pumping of hot gas from the plenum into the drum, the moisture-laden gas is exhausted through perforations 15 and enters shroud 34. From there, the pumping of gas causes the moisture-laden gas to enter conduit 38. Moisture is removed at device 41, preferably by discharging a portion of the gas to the environment. Fresh air having a preferably normal atmospheric oxygen content is added to recycle stream 37 at air inlet damper 42. Blower 44 supercharges the recycle stream into the atmosphere surrounding the inlet pipe 26 of the pulse jet engine. The supercharged atmosphere supports continuous combustion, and pulsating hot gas and sonic energy are pumped to plenum 18.

The drying process proceeds in a preferably inert or oxygen-depleted atmosphere in order to improve the characteristics of the finished product. Recycling also has the advantage of improved energy efficiency, since the recycle gases are warm and can serve as a medium of heat exchange with the pulse jet engine. Delicate flavoring ingredients or other volatile aromatics are better preserved in the product dried with recycled gas. Moreover, since the oxygen content of the pulsating hot gas is reduced compared to normal atmospheric conditions, drying occurs in an oxygen-depleted atmosphere. The oxygen depletion retards deleterious enzymatic and other chemical and organic reactions. The finished product is superior to products dried using only conventional hot gas sources, such as hot gas burners in atmospheric air.

The temperature of the gas in the plenum is preferably controlled by two methods. First, the rate of fuel consumption by the pulse jet engine is controlled so that the lower the fuel consumption rate, the lower the temperature of the hot pulsating gas entering the plenum 19. Second, by operating the damper valve 42, or adjusting the RPM of the blower, the quantity of air admitted through supercharging blower 44 is adjusted. Preferably, the air intake adjustment is coordinated with the operation of moisture removal device 41 to duplicate the volume of discharged recycle gas. The greater the volume of fresh air admitted into the system at the damper valve, the lower the temperature of the pulsating hot gas entering the plenum.

Preferably, the gas discharged through moisture removal device 41 is directed to pass around a bin containing a batch of untreated product which is next in line awaiting drying near the product inlet door 49. In this manner, the untreated product is preheated by conduction before processing in the drum, and the waste recycle gas serves as a medium for heat exchange without moisture condensation on the product. Alternately, the waste recycle gas may directly contact the product as long as no appreciable condensation forms on the product. The product may thus be preheated by convection with waste recycled gas with a suitable heat exchange device if necessary to prevent condensation forming on the particles. Condensation is undesirable, because any moisture condensing on the particle must then be removed inside the drum.

The dryer described above with reference to FIG. 1 is a batch dryer, where particles are loaded through inlet door 49 and hatch 16, the dryer is tumbled to dry a load of particles, and the dried load is withdrawn from the drum through hatch 16 and output door 50. However, this invention may also be practiced with a continuous flow dryer. In this embodiment, illustrated in FIG. 4, fresh moist particles are continuously introduced into the dryer by means of an air lock feed 60 and withdrawn from the dryer by means of an air lock output 62. Both the feed 60 and the output 62 comprise any rotary air lock valve capable of passing particles in one direction through the valve without appreciably changing the gas pressure on the drum side of the valve. Such rotary air lock valves are well known to those skilled in the art and have been used for feeding drying chambers which operate under an ambient or higher pressure.

A plurality of rotary dryers, such as have been illustrated and described with reference to FIG. 1 are coupled together in FIG. 4 to increase drying efficiency. In particular, two or more continuous feed dryers, such as is shown in FIG. 4, are coupled together with a transition air lock 61 between air lock output valve 62 of one dryer, and an air lock feed valve 60 of the other dryer. The transition air lock 61 comprises any air lock and shroud capable of passing material through output valve 62 or feed valve 60 without materially changing the gas pressure inside either drum. The flights 12 inside the two drums are coordinated to cause the material to travel along the drum rotational axes 11 from one end of one dryer to the opposite end of the other dryer at the other end of the chain. The advantage to staging two or more rotary dryers is that drying is initiated in the first dryer at a first temperature down to a first moisture content, while drying is continued in the second or subsequent dryer at a second temperature to a second moisture content which is lower than the first temperature and first moisture content. In this way, drying is carried out in stages with readily controlled temperatures, so that, as the drying progresses, and the particles are transferred from the initial dryer to a successive dryer, the temperature and moisture content progressively decreases. By operating with an initial high temperature and progressively decreasing the temperature as drying progresses, the efficiency of drying is increased.

Any number of dryers may be staged together, the major limitation being the cost of construction.

In FIG. 1, the recycle system, comprising the shroud, the conduit, and the pulse jet engine, is aligned roughly parallel with axis 11 of the drum. However, the recycle system can be perpendicular to the drum rotational axis, as in FIG. 2, and this arrangement accommodates staging several several rotary dryers in sequence. Moreover, the individual dryers are preferably enclosed in a single shroud 65 for insulating the drum, the gas plenum, and the pulse jet engine from loss of sonic energy to the environment. Such an arrangement is illustrated in FIG. 4, which is an illustration of an alternate preferred embodiment of this invention.

Having described the invention, its scope is intended to be limited only by the lawful scope of the appended claims.

What is claimed is:

1. Apparatus for drying particles, the apparatus comprising:

a cylindrical drum having a substantially horizontal axis and a perforated surface extending circumferentially of the drum over a selected portion of the length of the drum;

means for introducing moist particles into the drum;

means for rotating the drum about the axis to tumble the particles inside the drum;

a stationary gas plenum structure cooperating with a selected portion of the drum circumference and length in association with the drum perforated surface, for supply of gas into the drum via the perforated surface during rotation of the drum;

a pulse jet engine arranged to supply pulsating hot gas and broad band sonic energy to the plenum, whereby such gas and broad band sonic energy enter the drum and contact the tumbling particles to cause them to dry; and means for withdrawing dry particles from the drum.

2. Apparatus according to claim 1 wherein the pulsating hot gas and sonic energy flow through the drum transversely to the axis.

3. Apparatus according to claim 1 further comprising:

a shroud enclosing the drum for collecting gas flowing from the drum through the perforations and from the plenum; and means for recycling gas from the shroud to the pulse jet engine.

4. Apparatus according to claim 3 wherein the shroud defines a curved inner surface for reflecting sonic energy back into the drum.

5. Apparatus according to claim 3 wherein the pulsating hot gas in the plenum is maintained at or below a first predetermined temperature, and further comprising a second such apparatus wherein the pulsating hot gas in the second such plenum is maintained at or below a second predetermined temperature, the second temperature being less than the first temperature, and further comprising means to transfer the particles from the drum in the first such apparatus into the drum in the second such apparatus.

6. An apparatus according to claim 4 wherein the perforations occupy more than 40% of the drum surface over the selected length of the drum.

7. Apparatus according to claim 1 wherein the gas plenum is as long as the axis of the drum.

8. An apparatus according to claim 7 wherein the perforations occupy more than 40% of the drum surface.

9. Apparatus according to claim 3 further comprising:

means for removing moisture from the recycling gas.

10. A method for drying moist particles, the method comprising:

tumbling the moist particles in a drying space enclosed by a perforated cylindrical surface having a substantially horizontal longitudinal axis;

supplying pulsating hot gas and broad band sonic energy into the drying space transversely to the axis to contact the tumbling particles to cause them to dry; and withdrawing dried particles from the drying space.

11. The method according to claim 10 further comprising:

containing gas from the drying space; and recycling contained gas to a source supplying pulsating hot gas and sonic energy to the drying space.

12. The method according to claim 11 wherein the step of recycling contained gas further comprises:

discharging a portion of the contained gas to the environment; and introducing sufficient oxygen-containing gas to the source supplying pulsating hot gas and sonic energy to support continuous combustion, whereby further drying proceeds in an oxygen-depleted atmosphere.

13. The method according to claim 10 wherein the temperature of the pulsating hot gas supplied to the drying space is maintained at or below a predetermined upper limit by adjusting the rate of fuel consumption by the source supplying the pulsating hot gas and sonic energy.

14. The method according to claim 12 wherein the temperature of the pulsating hot gas supplied to the drying space is maintained at or below a predetermined upper limit by adjusting the rate at which oxygen-containing gas is introduced to the source supplying pulsating hot gas and sonic energy.

15. The method according to claim 10 wherein the particles are continuously introduced into the drying space.

16. The method according to claim 15 further comprising the step of causing the particles to flow from one end of the drying space along the horizontal axis to the other end as they tumble.

17. The method according to claim 10 further comprising the step of reflecting sonic energy from a surface outside the periphery of the drying space back through the tumbling particles.

18. A method for drying moist particles, the method comprising:

introducing moist particles into a drying space formed by a cylindrical perforated container;

supplying pulsating hot gas and broad band sonic energy through the perforations into the container, such pulsating hot gas and broad band sonic energy contacting a surface of the particles to cause them to dry;

agitating the container about a longitudinal axis inclined from vertical to expose a different surface of the particles to the pulsating hot gas and broad band sonic energy during the drying process; and withdrawing dried particles from the drying space.

19. The method according to claim 18 wherein the pulsating hot gas and sonic energy flow into the container transversely to the longitudinal axis.

20. The method according to claim 18 further comprising:

collecting gas from the container; and recycling collected gas to a source supplying pulsating hot gas and sonic energy to the container.

21. The method according to claim 20 wherein the step of recycling collected gas comprises:

discharging a portion of the gas to the environment; and introducing sufficient oxygen-containing gas to a source supplying pulsating hot gas and sonic energy to support continuous combustion therein, whereby further drying proceeds in an oxygen-depleted atmosphere.

22. The method according to claim 18 wherein the temperature of the pulsating hot gas supplied to the container is maintained at or below a predetermined upper limit by adjusting the rate of fuel consumption by a source supplying the pulsating hot gas and sonic energy.

23. The method according to claim 21 wherein the temperature of the pulsating hot gas supplied to the container is maintained at or below a predetermined upper limit by adjusting the rate at which the oxygen-containing gas is introduced to the source supplying pulsating hot gas and sonic energy.

24. The method according to claim 18 further comprising:

reflecting sonic energy from the cylindrical periphery of the container back through the particles.

25. The method according to claim 18 further comprising:

reflecting sonic energy from a concave surface outside the container back into the container and through the particles.

26. A method for drying moist nuts, the method comprising:

tumbling the moist nuts in a drying space formed by a perforated cylinder about a substantially horizontal axis;

supplying pulsating hot gas and broad band sonic energy via the perforations to the drying space transversely to the axis to contact the tumbling nuts to cause them to dry; and withdrawing dried nuts from the dry space.

27. An apparatus for drying particles, the apparatus comprising:

a cylindrical drum having a substantially horizontal axis and a perforated surface extending circumferentially of the drum over a selected portion of the length of the drum, the perforated surface being capable of transmitting sonic energy;

means for introducing moist particles into the drum;

a stationary gas plenum structure cooperating with a selected portion of the drum circumference and length in association with the drum perforated surface, for supply of gas into the drum via the perforated surface during rotation of the drum;

a pulse jet engine arranged to supply pulsating hot gas and broad band sonic energy to the plenum, whereby such gas and broad band sonic energy enter the drum transversely to its axis via the perforations and contact the tumbling particles to cause them to dry;

a shroud enclosing the drum in cooperation with the plenum structure, for collecting gas flowing from the drum and from the plenum, the shroud defining a curved inner surface for reflecting sonic energy, whereby sonic energy transmitted through the drum is reflected from the shroud back into the drum; and means for withdrawing dry particles from the drum.

* * * * *